US011828215B1

(12) United States Patent
Harkness

(10) Patent No.: US 11,828,215 B1
(45) Date of Patent: Nov. 28, 2023

(54) SELF-CLEANING PRIME MOVER EXHAUST SYSTEM AND METHOD

(71) Applicant: THERMO KING LLC, Minneapolis, MN (US)

(72) Inventor: Jeffrey G. Harkness, Minneapolis, MN (US)

(73) Assignee: THERMO KING LLC, Minneapolis, MN (US)

( * ) Notice: Subject to any disclaimer, the term of this patent is extended or adjusted under 35 U.S.C. 154(b) by 0 days.

(21) Appl. No.: 18/069,748

(22) Filed: Dec. 21, 2022

(51) Int. Cl.
*F01N 3/02* (2006.01)
*F01N 13/08* (2010.01)
*F01N 3/00* (2006.01)

(52) U.S. Cl.
CPC ..... *F01N 13/082* (2013.01); *F01N 3/005* (2013.01); *F01N 3/02* (2013.01); *F01N 2260/06* (2013.01); *F01N 2470/30* (2013.01); *F01N 2590/08* (2013.01)

(58) Field of Classification Search
CPC ..... F01N 3/005; F01N 2470/30
See application file for complete search history.

(56) References Cited

U.S. PATENT DOCUMENTS 5,189,878 A * 3/1993 Robinson ..... F01N 3/005 60/309
8,820,475 B2 9/2014 Pradhan
10,309,288 B2 * 6/2019 Endo ..... F01N 13/085
2006/0124116 A1 6/2006 Bui
2018/0179943 A1 * 6/2018 Oya ..... F01N 3/005
2019/0107032 A1 * 4/2019 Utsunomiya ..... F01N 13/1877

FOREIGN PATENT DOCUMENTS

DE 3402810 A * 8/1984 ..... F01N 3/005
JP H04-037829 U * 3/1992
JP 2015158149 A * 9/2015

OTHER PUBLICATIONS

Machine translation of JP-2015158149-A, accessed Apr. 4, 2023. (Year: 2023).*
Machine translation of DE-3402810-A, accessed Apr. 4, 2023. (Year: 2023).*

* cited by examiner

*Primary Examiner* — Jonathan R Matthias
(74) *Attorney, Agent, or Firm* — Hamre, Schumann, Mueller & Larson, P.C.

(57) ABSTRACT

This disclosure relates generally to a prime mover system. More specifically, this disclosure relates to a prime mover exhaust system that can prevent the accumulation of debris (e.g., soot or unburned fuel) in the prime mover system. In accordance with at least one embodiment described and recited herein, a self-cleaning prime mover exhaust system is provided. The prime mover exhaust system includes an exhaust tip, an exhaust pipe, and a cleaning tube. The exhaust tip is configured to eject exhaust out of the prime mover exhaust system, the exhaust pipe is configured to direct the exhaust away from a prime mover, and the cleaning tube is configured to accumulate debris exiting from the exhaust pipe and configured to vacuum the debris out of the self-cleaning prime mover exhaust system through the exhaust tip using the Venturi effect.

20 Claims, 9 Drawing Sheets

SELF-CLEANING PRIME MOVER EXHAUST SYSTEM AND METHOD

FIELD

This disclosure relates generally to a prime mover system. More specifically, this disclosure relates to a self-cleaning prime mover exhaust system that can self-clean to remove the accumulation of debris (e.g., soot or unburned fuel) in the prime mover system.

BACKGROUND

A prime mover system is generally a mechanical system using a prime mover to convert one or more forms of energy into mechanical force, and making use of the mechanical force to realize some kind of specific function, like climate control, wheel driving, or concrete mixing. Examples of the prime mover include, but are not limited to an engine or motor used in a transport unit. Examples of transport units include, but are not limited to a truck, a container (such as a container on a flat car, an intermodal container, a marine container, a rail container, etc.), a box car, a semi-tractor, a bus, or other similar transport units.

Exhaust waste may be generated during the energy-converting process of the prime mover. Thus, one or more prime mover exhaust systems may be provided in a prime mover system to discharge the exhaust waste.

SUMMARY

This disclosure relates generally to a prime mover system. More specifically, this disclosure relates to a self-cleaning prime mover exhaust system that can self-clean to remove the accumulation of debris (e.g., soot or unburned fuel) in the prime mover system.

In accordance with at least one embodiment described and recited herein, a self-cleaning prime mover exhaust system is provided. The self-cleaning prime mover exhaust system includes an exhaust tip, an exhaust pipe, and a cleaning tube. The exhaust tip is configured to eject exhaust out of the self-cleaning prime mover exhaust system, the exhaust pipe is configured to direct the exhaust away from a prime mover, and the cleaning tube is configured to accumulate debris exiting from the exhaust pipe and configured to vacuum the debris out of the self-cleaning prime mover exhaust system through the exhaust tip using the Venturi effect.

Specifically, the exhaust pipe includes a first exhaust section and a second exhaust section. The first exhaust section includes a side wall opening, and the second exhaust section includes an exhaust opening configured to direct the exhaust out of the exhaust pipe.

The cleaning tube includes a first end and a second end, and the cleaning tube has a smaller sectional area compared with the exhaust tip. The cleaning tube further includes a first cleaning section and a second cleaning section. The first cleaning section covers the sidewall opening to make sure the debris exiting from the sidewall opening can be accumulated in the cleaning tube. The first cleaning section includes a first cleaning opening at the first end of the cleaning tube. The second cleaning section extends through the exhaust tip and includes a second cleaning opening at the second end of the cleaning tube.

In accordance with at least one other embodiment described and recited herein, a prime mover system is provided. The prime mover system includes a prime mover configured to generate mechanical power, and a self-cleaning prime mover exhaust system mentioned above configured to self-clean to remove the debris accumulated.

In accordance with at least one other embodiment described and recited herein, a method for self-cleaning debris from a self-cleaning prime mover exhaust system mentioned above is provided. The method includes directing exhaust away from the prime mover through the exhaust pipe during a working cycle of the prime mover; accumulating debris exiting the sidewall opening into the cleaning tube; and vacuuming debris through the cleaning tube and out of the self-cleaning prime mover exhaust system through the exhaust tip.

In accordance with the embodiments described and recited herein, debris may flow back in the exhaust pipe since there would be no exhaust flow in the exhaust pipe between the working cycles of the prime mover, and the debris would exit from the sidewall opening of the exhaust pipe and would be accumulated in the first cleaning section of the cleaning tube. Since the cleaning tube has a smaller sectional area compared with the exhaust tip, vacuuming air flow can be formed in the cleaning tube because of the Venturi effect, and the accumulated debris will be vacuumed through the cleaning tube and discharged out of the self-cleaning prime mover exhaust system through the exhaust tip. Thus, the safety risk that would be caused by the accumulated debris can be effectively reduced.

BRIEF DESCRIPTION OF THE DRAWINGS

In the detailed description that follows, embodiments are described as illustrations only since various changes and modifications will become apparent to those skilled in the art from the following detailed description. The use of the same reference numbers in different figures indicates similar or identical items.

DETAILED DESCRIPTION

Figure 1A:
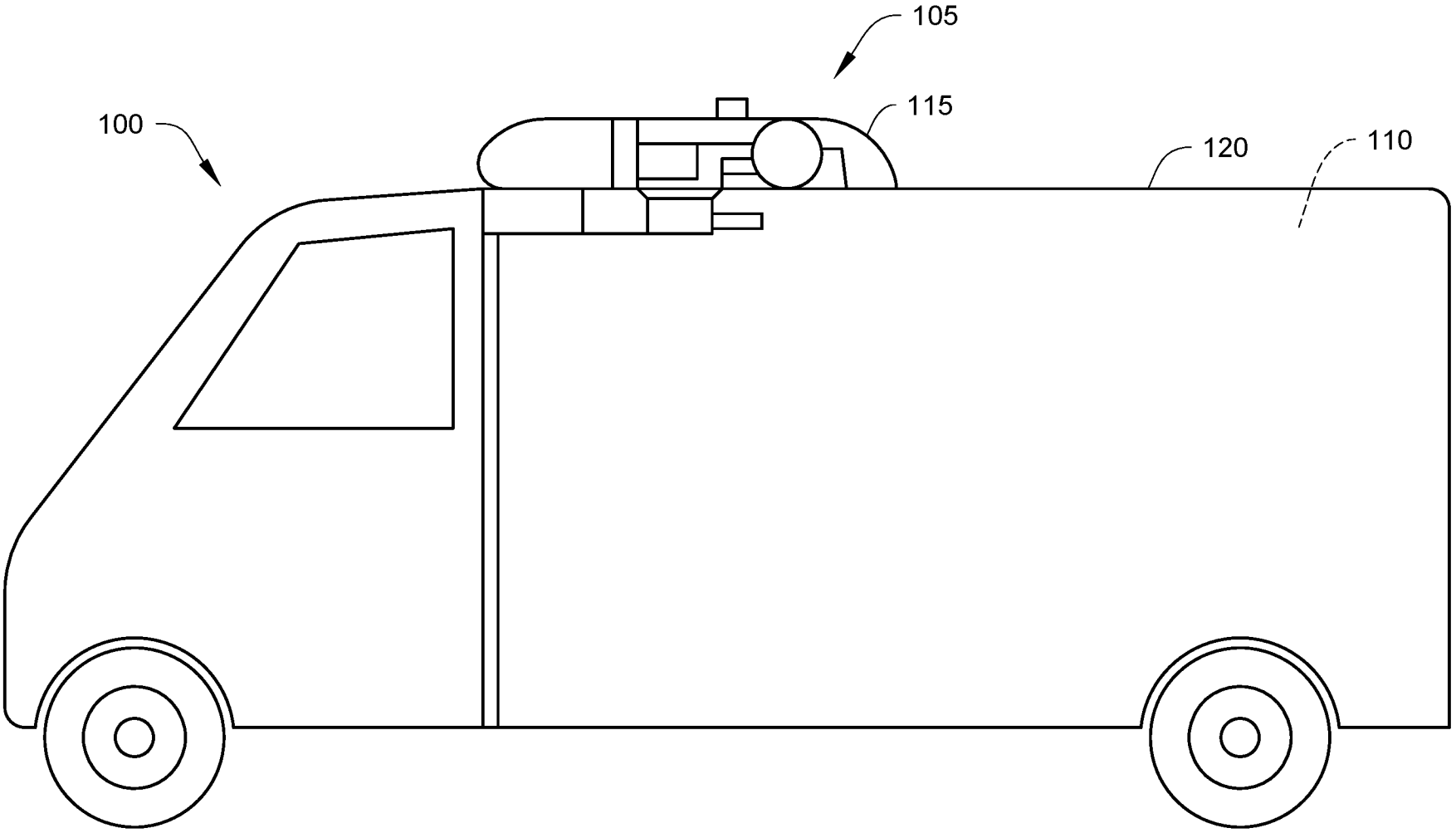
FIG. 1A is a side view of a van with a transport climate control system, in accordance with one or more embodiments described and recited herein.

This disclosure relates generally to a prime mover system. More specifically, this disclosure relates to a self-cleaning prime mover exhaust system that can self-clean to remove the accumulation of debris (e.g., soot or unburned fuel) in the prime mover system.

In the following detailed description, reference is made to the accompanying drawings, which form a part of the description. In the drawings, similar symbols typically identify similar components, unless context dictates otherwise. Furthermore, unless otherwise noted, the description of each successive drawing may reference features from one or more of the previous drawings to provide clearer context and a more substantive explanation of the current example embodiment. Still, the example embodiments described in the detailed description, drawings, and claims are not intended to be limiting. Other embodiments may be utilized, and other changes may be made, without departing from the spirit or scope of the subject matter presented herein. It will be readily understood that the aspects of the present disclosure, as generally described herein and illustrated in the drawings, may be arranged, substituted, combined, separated, and designed in a wide variety of different configurations, all of which are explicitly contemplated herein.

In the present description and recitation, the following terms may be used, in addition to their accepted meaning, as follows:

A prime mover system is a mechanical system using a prime mover to convert one or more forms of energy into mechanical force, and making use of the mechanical force to realize some kind of specific function, like climate control, wheel driving, or concrete mixing. Examples of the prime mover include, but are not limited to, an engine or motor used in a transport unit. Examples of transport units include, but are not limited to a truck, a container (such as a container on a flat car, an intermodal container, a marine container, a rail container, etc.), a box car, a semi-tractor, a bus, or other similar transport units. A refrigerated transport unit is commonly used to transport perishable items such as pharmaceuticals, produce, frozen foods, and meat products.

A self-cleaning prime mover exhaust system is generally a system configured to discharge the exhaust waste generated during the energy-converting process of the prime mover. In at least one embodiment of the present application, the self-cleaning prime mover exhaust system is further configured to self-clean to remove the accumulation of debris formed by the energy-converting process, like soot or unburned fuel formed by an incomplete fuel burning process. The accumulation of the debris may have a safety risk to be ignited by the burning sparks expelled by the prime mover. Furthermore, cosmetic benefits would also be achieved by preventing the accumulation of exhaust deposits on equipment such as an exterior of a transport climate control unit, an exterior of exterior transport container, or other exterior surfaces.

The Venturi effect is a physical phenomenon of the reduction in fluid pressure that results when a fluid flows through a constricted section of a pipe. When a fluid is flowing through a pipe including a first section with a comparatively larger section area and a second section with a comparatively smaller section area, the fluid pressure in the second section will be lower than the fluid pressure in the first section.

A transport climate control system may control one or more environmental conditions within a transport unit that include but are not limited to temperature, humidity, air quality, or combinations thereof.

A climate-controlled transport unit, e.g., a transport unit including a climate control system, may be used to transport perishable items including, but not limited to, produce, frozen foods, meat products, dairy products, etc.

A climate control system is generally used to control one or more environmental conditions such as, but not limited to, temperature, humidity, and/or air quality of a transport unit. A climate control system may include, for example, one or more of a refrigeration system to control the refrigeration of a climate-controlled space of a refrigerated transport unit; a vapor-compressor type refrigeration system, a thermal accumulator type system, or any other suitable refrigeration system that may use refrigerant, cold plate technology, etc.

A climate control system may further include a climate control unit (CCU) attached to a transport unit to control one or more environmental conditions (e.g., temperature, humidity, air quality, etc.) of a climate-controlled space of the refrigerated transport unit. The CCU may include, without limitation, one or more of a compressor, a condenser, an expansion valve, an evaporator, and one or more fans or blowers to control the heat exchange between the air within the climate-controlled space and the ambient air outside of the refrigerated transport unit.

Figure 1B:
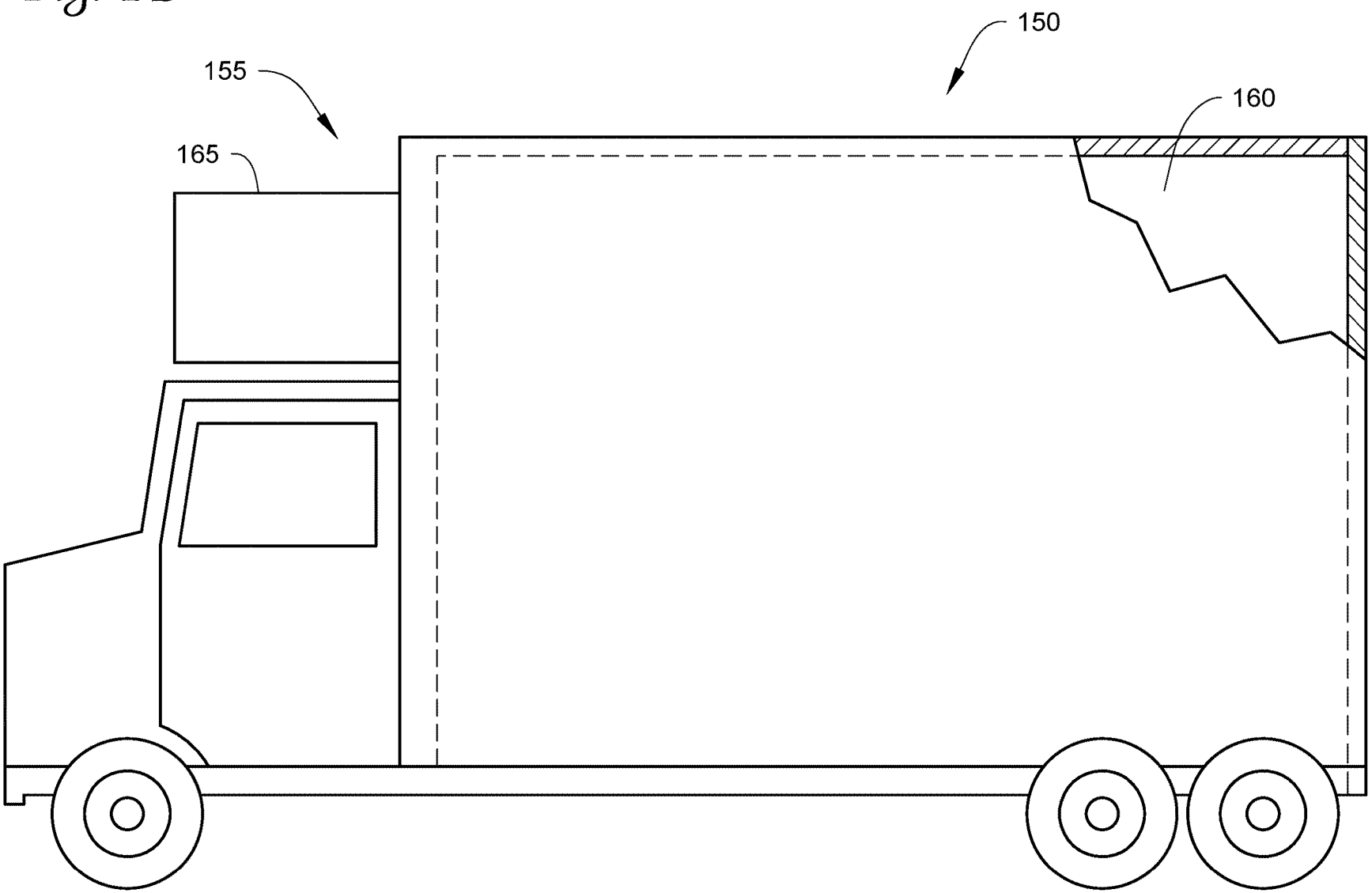
FIG. 1B is a side view of a truck with a transport climate control system, in accordance with one or more embodiments described and recited herein.
Figure 1C:
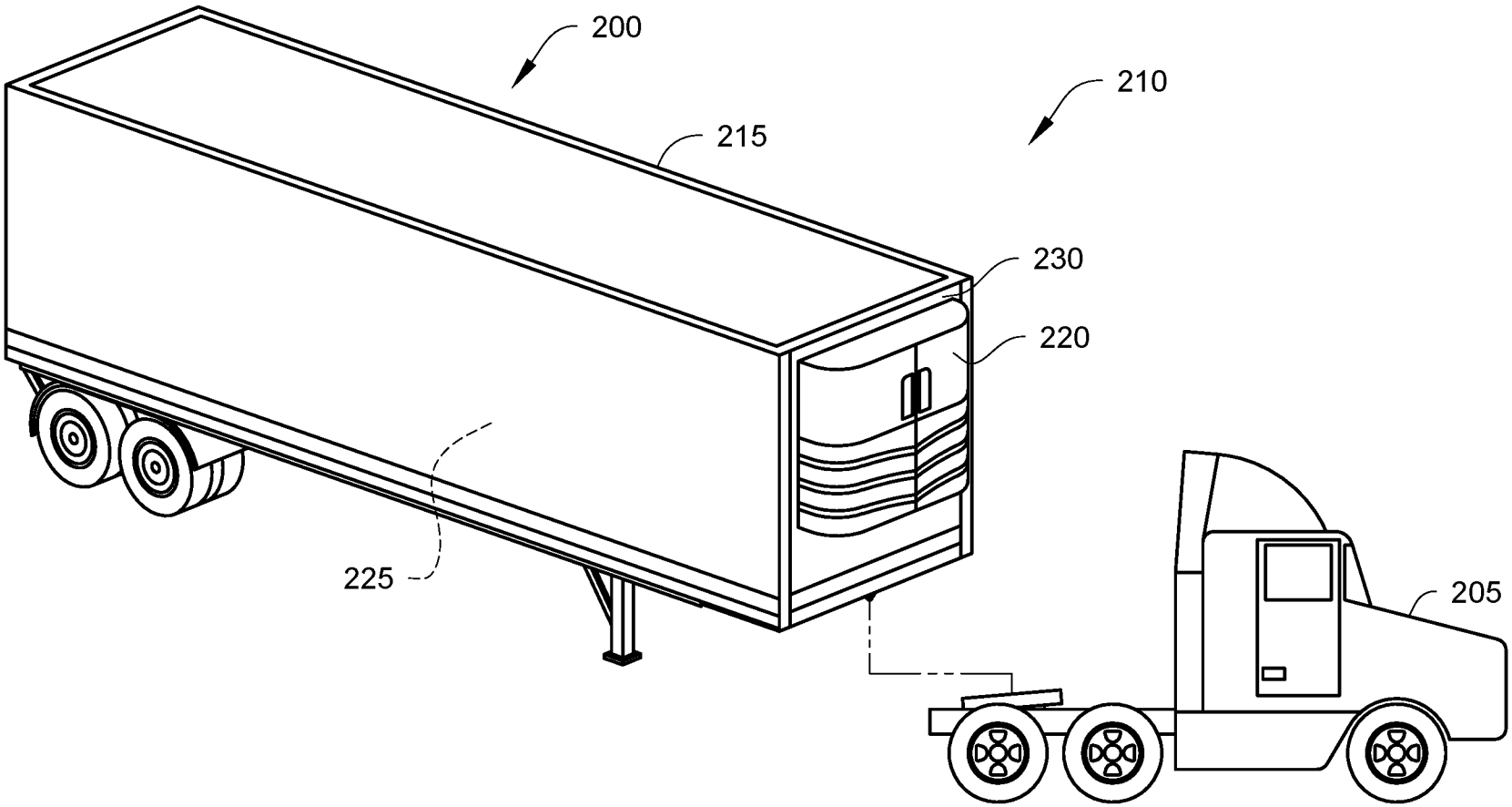
FIG. 1C is a perspective view of a climate controlled transport unit attachable to a tractor, in accordance with one or more embodiments described and recited herein.
Figure 1D:
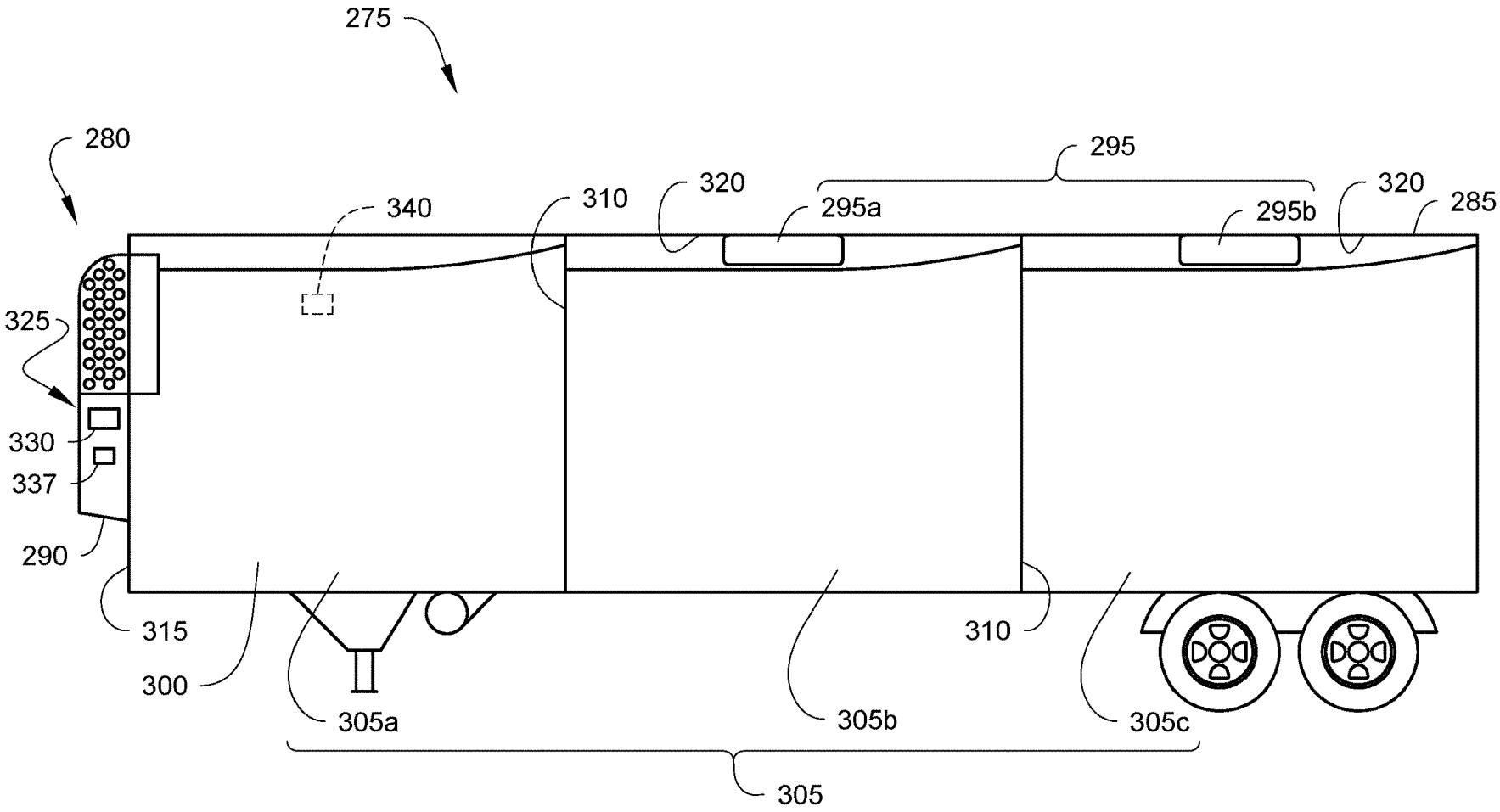
FIG. 1D is a side view of a climate controlled transport unit including a multi-zone transport climate control system, in accordance with one or more embodiments described and recited herein.

FIGS. 1A-1D show various transport climate control systems. FIG. 1A is a side view of a van 100 with a transport climate control system 105, in accordance with one or more embodiments described and recited herein. FIG. 1B is a side view of a truck 150 with a transport climate control system 155, in accordance with one or more embodiments described and recited herein. FIG. 1C is a perspective view of a climate controlled transport unit 200 attachable to a tractor 205, in accordance with one or more embodiments described and recited herein. FIG. 1D is a side view of a climate controlled transport unit 275 including a multi-zone transport climate control system 280, in accordance with one or more embodiments described and recited herein. It will be appreciated that the embodiments described are not limited to the transport units shown in FIGS. 1A-1D, but may apply to any type of transport unit (e.g., a truck, a container (such as a container on a flat car, an intermodal container, a marine container, a rail container, etc.), a box car, a semi-tractor, a bus, or other similar transport unit), within the scope of the principles of this disclosure.

FIG. 1A depicts the van 100 having the climate control system 105 for providing climate control within a climate controlled space 110. The transport climate control system 105 includes a climate control unit (CCU) 115 that is mounted to a rooftop 120 of the van 100. In accordance with one or more embodiments described and recited herein, the CCU 115 may be a transport refrigeration unit.

The CCU 115 may include, among other components, a climate control circuit that connects, for example, a compressor, a condenser, an evaporator, and an expansion device (e.g., an expansion valve) to provide climate control within the climate controlled space 110.

FIG. 1B depicts the climate-controlled straight truck 150 that includes the climate controlled space 160 for carrying cargo and the transport climate control system 155. The transport climate control system 155 includes a CCU 165 that is mounted to a front wall 170 of the climate controlled space 160. The CCU 165 may include, among other components, a climate control circuit that connects, for example, a compressor, a condenser, an evaporator, and an expansion device to provide climate control within the climate controlled space 160. In accordance with one or more embodiments described and recited herein, the CCU 165 may be a transport refrigeration unit.

FIG. 1C illustrates one embodiment of the climate controlled transport unit 200 attached to a tractor 205. The climate controlled transport unit 200 includes a transport climate control system 210 for a transport unit 215. The tractor 205 is attached to and may be configured to tow the transport unit 215. The transport unit 215 shown in FIG. 1C is a trailer.

The transport climate control system 210 may include, among other components, a CCU 220 that provides environmental control (e.g. temperature, humidity, air quality, etc.) within a climate controlled space 225 of the transport unit 215. The CCU 220 is disposed on a front wall 230 of the transport unit 215. In at least one or more other embodiments, the CCU 220 may be disposed, for example, on a rooftop or another wall of the transport unit 215. The CCU 220 includes a climate control circuit that connects, for example, a compressor, a condenser, an evaporator, and an expansion device to provide conditioned air within the climate controlled space 225. In accordance with one or more embodiments described and recited herein, the CCU 220 may be a transport refrigeration unit.

FIG. 1D illustrates an embodiment of the climate controlled transport unit 275. The climate controlled transport unit 275 includes the multi-zone transport climate control system (MTCS) 280 for a transport unit 285 that may be towed, for example, by a tractor (not shown). It will be appreciated that the embodiments described herein are not limited to tractor and trailer units, but may apply to any type of transport unit (e.g., a truck, a container (such as a container on a flat car, an intermodal container, a marine container, a rail container, etc.), a box car, a semi-tractor, a bus, or other similar transport unit), etc.

The MTCS 280 includes a CCU 290 and a plurality of remote units 295 that provide environmental control (e.g. temperature, humidity, air quality, etc.) within a climate controlled space 300 of the transport unit 275. The climate controlled space 300 may be divided into a plurality of zones 305. The term "zone" means a part of an area of the climate controlled space 300 separated by walls 310. The CCU 290 may operate as a host unit and provide climate control within a first zone 305*a* of the climate controlled space 300. The remote unit 295*a* may provide climate control within a second zone 305*b* of the climate controlled space 300. The remote unit 295*b* may provide climate control within a third zone 305*c* of the climate controlled space 300. Accordingly, the MTCS 280 may be used to separately and independently control environmental condition(s) within each of the multiple zones 305 of the climate controlled space 300.

The CCU 290 is disposed on a front wall 315 of the transport unit 275. In one or more other embodiments, the CCU 290 may be disposed, for example, on a rooftop or another wall of the transport unit 275. The CCU 290 includes a climate control circuit that connects, for example, a compressor, a condenser, an evaporator, and an expansion device to provide conditioned air within the climate controlled space 300. The remote unit 295*a* is disposed on a ceiling 320 within the second zone 305*b* and the remote unit 295*b* is disposed on the ceiling 320 within the third zone 305*c*. Each of the remote units 295*a* and 295*b* includes an evaporator that connects to the rest of the climate control circuit provided in the CCU 290. In accordance with one or more embodiments described and recited herein, the CCU 290 may be a transport refrigeration unit.

The MTCS 280 may also include a programmable climate controller 325 and one or more climate control sensors (not shown) that are configured to measure one or more parameters of the MTCS 280 (e.g., an ambient temperature outside of the transport unit 275, an ambient humidity outside of the transport unit 275, a compressor suction pressure, a compressor discharge pressure, supply air temperatures of air supplied by the CCU 290 and the remote units 295 into each of the zones 305, return air temperatures of air returned from each of the zones 305 back to the respective CCU 290 or remote unit 295*a* or 295*b*, a humidity within each of the zones 305, etc.) and communicate climate control data to a climate controller 325. The one or more climate control sensors may be positioned at various locations outside the transport unit 275 and/or inside the transport unit 275 (including within the climate controlled space 300).

The climate controller 325 may be configured to control operation of the MTCS 280 including components of the climate control circuit. The climate controller 325 may include a single integrated control unit 330 or may include a distributed network of climate controller elements 330, 337. The number of distributed control elements in a given network may depend upon the particular application of the principles described herein. The measured parameters obtained by the one or more climate control sensors may be used by the climate controller 325 to control operation of the MTCS 280.

Figure 2:
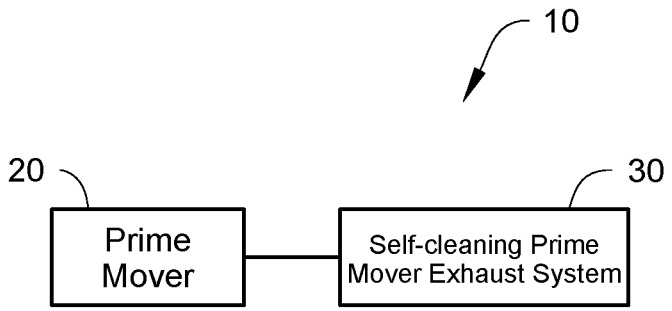
FIG. 2 shows a block diagram of a prime mover system, according to at least one embodiment described and recited herein.

FIG. 2 shows a block diagram of a prime mover system, according to at least one embodiment described and recited herein. As shown in FIG. 2, the prime mover system 10 includes a prime mover 20 configured to generate mechanical power, and a self-cleaning prime mover exhaust system 30 mentioned above configured to self-clean to remove the debris accumulated.

The prime mover 20 is configured to convert one or more forms of energy into mechanical force, and the mechanical force is used to realize some kind of specific function of the prime mover system 10. For example, the prime mover 20 may be a diesel/gasoline motor used for driving the vehicle wheels of a truck or trailer, or driving a compressor, a condenser, an evaporator, or an expansion device (e.g., an expansion valve) to provide climate control. The specific models of the prime mover 20 may vary with the specific functions to be realized by the prime mover system 10 and are not limited to the above examples.

The self-cleaning prime mover exhaust system 30 is generally configured to discharge the exhaust formed by the energy-converting process. However, when the prime mover 20 is working to provide mechanical power, debris may be also created together with the exhaust during the energy-converting process. For example, soot and unburned fuel may be created when the prime mover 20 is implementing a cold start under a low load status. During a cold start process, the prime mover 20 may execute multiple working cycles to make sure a successful ignition. In each working cycle, the debris may flow with the exhaust and be discharged by the self-cleaning prime mover exhaust system 30. But between the working cycles, since the prime mover 20 is not implementing the energy-converting process and no new exhaust is created, there would be no exhaust flow in the self-cleaning prime mover exhaust system 30. The exhaust would not be pushed out of the exhaust system, and the debris would flow back with the exhaust and be accumulated somewhere in the exhaust system, or exit from some opening of the exhaust system and be accumulated outside the exhaust system. In this case, when the next working cycle comes, burning embers or sparks would be expelled when the prime mover 20 starts another ignition process, and the accumulated debris would have a risk to be ignited by the burning embers or sparks, which may cause severe safety problem of the whole prime mover system 10. Thus, in order to reduce the safety risk mentioned above, the self-cleaning prime mover exhaust system 30, according to at least one embodiment of the present application, is further configured to self-clean to remove the accumulation of debris.

In some embodiment of the present application, the prime mover system 10 may further include an exhaust fan 40 configured to vacuum the exhaust from the self-cleaning prime mover exhaust system 30.

Figure 3:
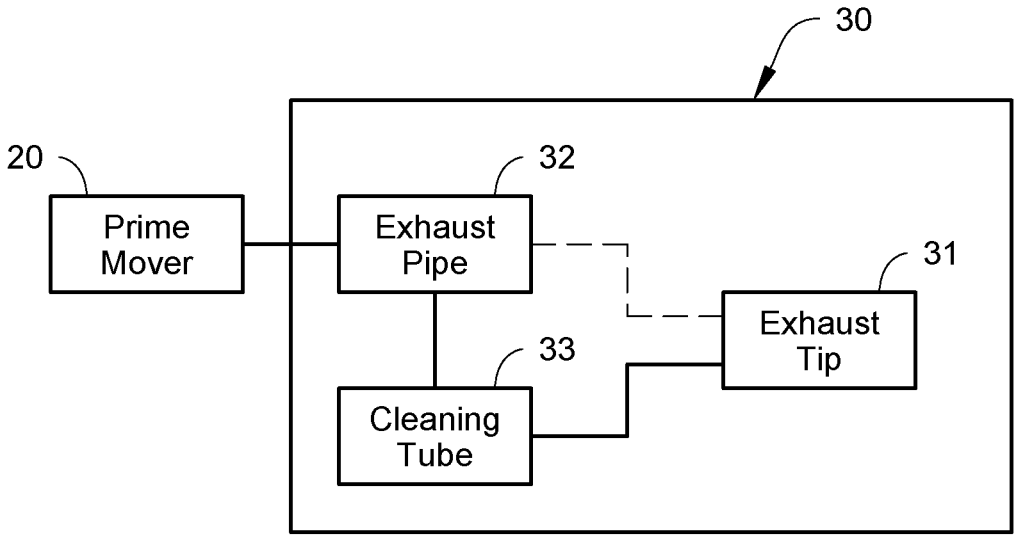
FIG. 3 shows a block diagram of a self-cleaning prime mover exhaust system, according to at least one embodiment described and recited herein.

FIG. 3 shows a block diagram of a self-cleaning prime mover exhaust system, according to at least one embodiment described and recited herein. As shown in FIG. 3, the self-cleaning prime mover exhaust system 30 includes an exhaust tip 31, an exhaust pipe 32, and a cleaning tube 33. The exhaust tip 31 is configured to eject exhaust out of the self-cleaning prime mover exhaust system 30, the exhaust pipe 32 is configured to direct the exhaust away from a prime mover 20, and the cleaning tube 33 is configured to accumulate debris exiting from the exhaust pipe 32 and vacuum the debris out of the self-cleaning prime mover exhaust system 30 through the exhaust tip 31.

Specifically, the exhaust pipe 32 includes a first exhaust section 321 and a second exhaust section 322. The first exhaust section 321 includes a sidewall opening 323, and the second exhaust section 322 includes an exhaust opening 324 configured to direct the exhaust out of the exhaust pipe 32.

The cleaning tube 33 includes a first end 331 and a second end 332, and the cleaning tube 33 has a smaller sectional area compared with the exhaust tip 31. The cleaning tube 33 further includes a first cleaning section 333 and a second cleaning section 334. The first cleaning section 333 covers the sidewall opening 323 to make sure the debris exiting from the sidewall opening 323 can be accumulated in the cleaning tube 33. The first cleaning section 333 includes a first cleaning opening 335 at the first end 331 of the cleaning tube 33. The second cleaning section 334 extends through the exhaust tip 31 and includes a second cleaning opening 336 at the second end 332 of the cleaning tube 33.

As discussed above, debris may flow back in the exhaust pipe 32 since there would be no exhaust flow in the exhaust pipe 32 between the working cycles of the prime mover 20, and the debris would exit from the sidewall opening 323 of the exhaust pipe 32 and would be accumulated in the first cleaning section 333 of the cleaning tube 33. Since the cleaning tube 33 has a smaller sectional area compared with the exhaust tip 31, vacuuming air flow can be formed in the cleaning tube 33 because of the Venturi effect, and the accumulated debris will be vacuumed through the cleaning tube 33 and discharged out of the self-cleaning prime mover exhaust system 30 through the exhaust tip 31. Thus, the safety risk that would be caused by the accumulated debris can be effectively reduced.

Figure 4:
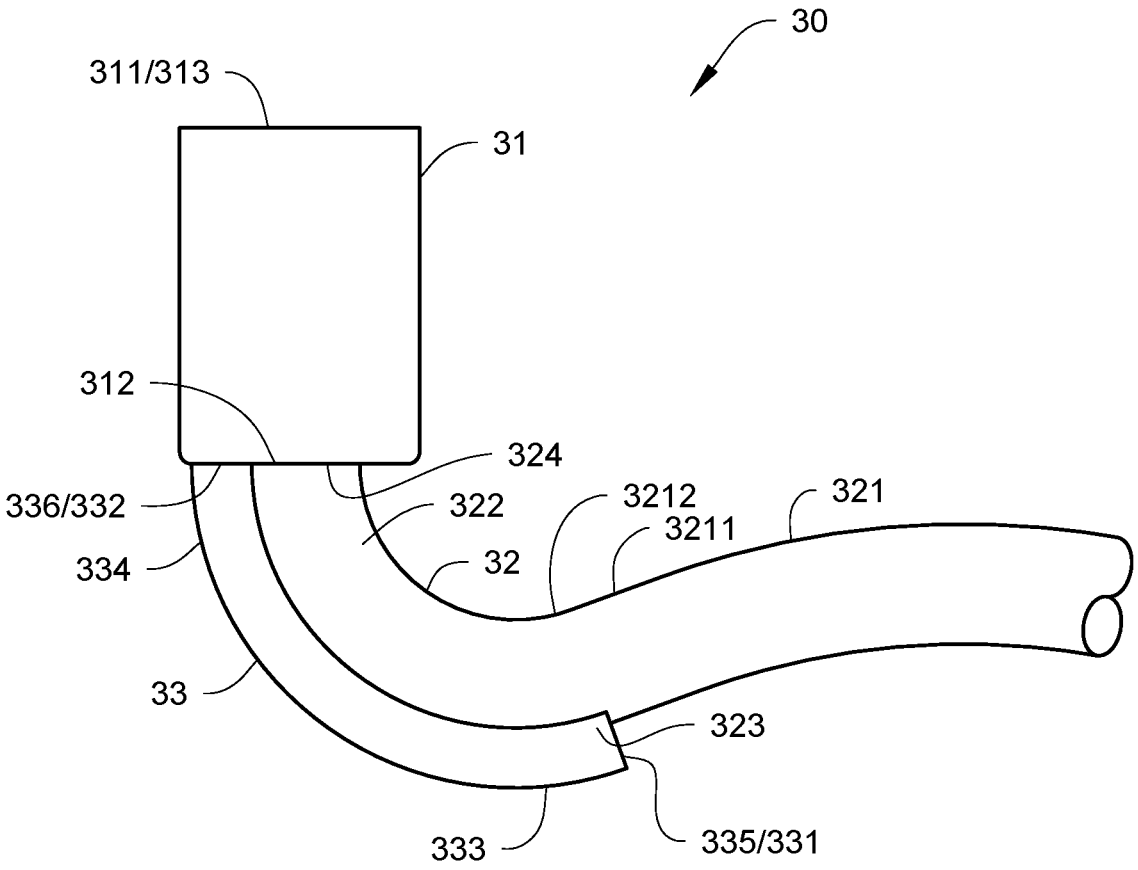
FIG. 4 shows a schematic diagram of a self-cleaning prime mover exhaust system, according to at least one embodiment described and recited herein.
Figure 5:
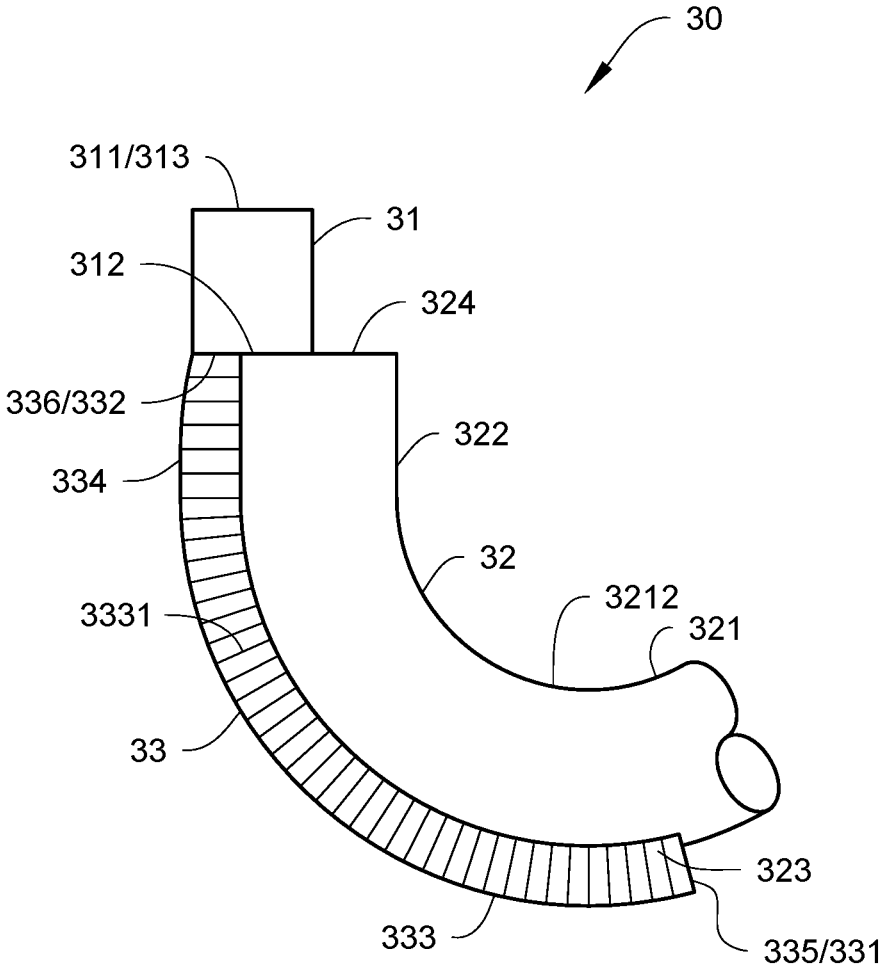
FIG. 5 shows a schematic diagram of another self-cleaning prime mover exhaust system, according to at least one embodiment described and recited herein.

FIG. 4 shows a schematic diagram of a self-cleaning prime mover exhaust system 30, according to at least one embodiment described and recited herein. FIG. 5 shows a schematic diagram of another self-cleaning prime mover exhaust system 30, according to at least one embodiment described and recited herein.

As shown in FIGS. 4 and 5, in some embodiments of the present application, the second exhaust section 322 may extend through the exhaust tip 31 to direct the exhaust into the exhaust tip 31. In this case, the exhaust tip 31 would also be configured to discharge the exhaust out of the self-cleaning prime mover exhaust system 30, so the exhaust tip 31 can be commonly used by the exhaust pipe 32 and the cleaning tube 33 as a discharging output, and the size of the whole self-cleaning prime mover exhaust system 30 could be smaller to save the inside space of the prime mover system 10. Specifically, during the working cycle of the prime mover 20, the exhaust tip 31 can discharge the exhaust and the debris coming through the exhaust pipe 32; between the working cycle of the prime mover 20, the exhaust tip 31 can discharge the debris coming through the cleaning tube 33.

As shown in FIG. 4, in some embodiments of the present application, the exhaust tip 31 may include an exhaust end 311, and both the second exhaust section 322 and the second cleaning section 334 may extend through the exhaust end 311. In this case, the exhaust tip 31 can be commonly used by the exhaust pipe 32 and the cleaning tube 33 as a discharging output, and the second exhaust section 322 and the second cleaning section 334 more specifically extend through one same end of the exhaust tip 31. Thus, the size of the whole self-cleaning prime mover exhaust system 30 could be much smaller, and the manufacturing cost and difficulties of the self-cleaning prime mover exhaust system 30 would be reduced.

As shown in FIG. 4, in some embodiments of the present application, the exhaust tip 31 may have a larger sectional area compared with the exhaust pipe 32. In this case, the Venturi effect could also be taken advantage of during the working cycle of the prime mover 20. Specifically, the exhaust flow would have a lower pressure in exhaust pipe 32 compared with that in exhaust tip 31, since exhaust pipe 32 has a smaller section area compared with exhaust tip 31. Thus, external vacuuming air flow would be formed at the sidewall opening 323 of the exhaust pipe 32, and the external vacuuming air flow can further facilitate the discharging of the exhaust from the exhaust pipe 32 to the exhaust tip 31.

As shown in FIG. 4, in some embodiments of the present application, both the exhaust opening 324 and the second cleaning opening 336 may be disposed of within the exhaust end 311. In this case, the exhaust end 311 has a larger sectional area compared with the exhaust pipe 32, Venturi effect could also be taken advantage of to form the external vacuuming air flow facilitating the discharging of the exhaust from the exhaust pipe 32 to the exhaust tip 31. In the meantime, the second exhaust section 322 and the second cleaning section 334 more specifically extend through one same end of the exhaust tip 31, so that the size of the whole self-cleaning prime mover exhaust system 30 could be much smaller, and the manufacturing cost and difficulties of the self-cleaning prime mover exhaust system 30 could be reduced.

As shown in FIG. 5, in some embodiments of the present application, the exhaust tip 31 may include an exhaust input opening 312, both the second exhaust section 322, and the second cleaning section 334 may extend through the exhaust input opening 312. The exhaust input opening 312 may have a sectional area that is larger compared with the second cleaning opening 336 but smaller compared with the second exhaust opening 324. In this case, the Venturi effect can be made sure to be taken advantage of between the working cycles of the prime mover 20, since the exhaust input opening 312 has a sectional area that is larger compared with the second cleaning opening 336. In addition, since the sectional area of the exhaust input opening 312 is also smaller than that of the second exhaust opening 324, the sidewall of the exhaust tip 31 would not protrude from the sidewall of the second exhaust opening 324. Thus, the size of the whole self-cleaning prime mover exhaust system 30 could be smaller to save the inside space of the prime mover system 10, and the exhaust tip 31 could also be commonly used by the exhaust pipe 32 and the cleaning tube 33 as a discharging output.

As shown in FIG. 4, in some embodiments of the present application, the exhaust tip 31 may include an exhaust output opening 313 configured to be exposed to an outside ambient. In this case, the exhaust will be discharged into the air. However, in some other embodiments of the present application, the exhaust output opening 313 may extend through another system configured to collect or make use of the exhaust, for example, some exhaust recycling system, so that the surrounding environment can be protected from pollution.

As shown in FIGS. 4 and 5, in some embodiments of the present application, the first exhaust section 321 may include a curved section 3211, and the sidewall opening 323 may be located at an inflection position 3212 of the curved section 3211. In some embodiments, the first exhaust section 321 may include multiple curved sections 3211, so that the exhaust pipe 32 is in an "S" shape. Since the debris would suffer resistance when flows in the curved section 3211 and so would be easier being accumulated at the inflection position 3212 of the curved section 3211, disposing of the sidewall opening 323 at the inflection position 3212 could help the debris exiting from the exhaust pipe 32. More specifically, in some embodiments, the inflection position 3212 would be at a bottom of the curved section 3211 along a direction of gravity. In this case, the debris would automatically fall from the sidewall opening 323 at the inflection position 3212 because of gravity, which further facilitates the exiting of the debris from the exhaust pipe 32. More specifically, in some embodiments, the sidewall opening 323 may be a water drain hole configured to direct water out of the exhaust pipe 32 towards a water drain. In this case, wastewater created during the working cycle of the prime mover 20 would fall with the debris from the sidewall opening 323, and would not flow back to the prime mover 20, so the safety risks would be caused by wastewater are further reduced.

As shown in FIG. 4, in some embodiments of the present application, the first cleaning section 333 or the second cleaning section 334 includes a half tube disposed of on a surface of the exhaust pipe 32 and extending along the exhaust pipe 32. The coupling manner of the half tube and the exhaust pipe 32 may be, but is not limited to, welding, riveting, adhesive bonding, or screw joint. In this case, the surface of the exhaust pipe 32 can be used as a half sidewall of the first cleaning section 333 or the second cleaning section 334, so that the size of the whole self-cleaning prime mover exhaust system 30 could be smaller, and the manufacturing cost of the cleaning tube 33 could be reduced. As shown in FIG. 5, in some other embodiments of the present application, the first cleaning section 333 or the second cleaning section 334 may include multiple end-to-end sections 3331. The angles between each two adjacent end-to-end sections 3331 can be easily adjusted, so that the cleaning tube 33 can be more easily manufactured to couple with and extend along the surface of the exhaust pipe 32. Thus, the size of the whole self-cleaning prime mover exhaust system 30 could be smaller, and the manufacturing difficulties of the cleaning tube 33 could be reduced.

In some other embodiments, the exhaust tip 31, the exhaust pipe 32, and the cleaning tube 33 may be manufactured or connected in some other manners. The manufacturing and connecting manners of the exhaust tip 31, the exhaust pipe 32, and the cleaning tube 33 are not limited to the examples discussed above.

Figure 6:
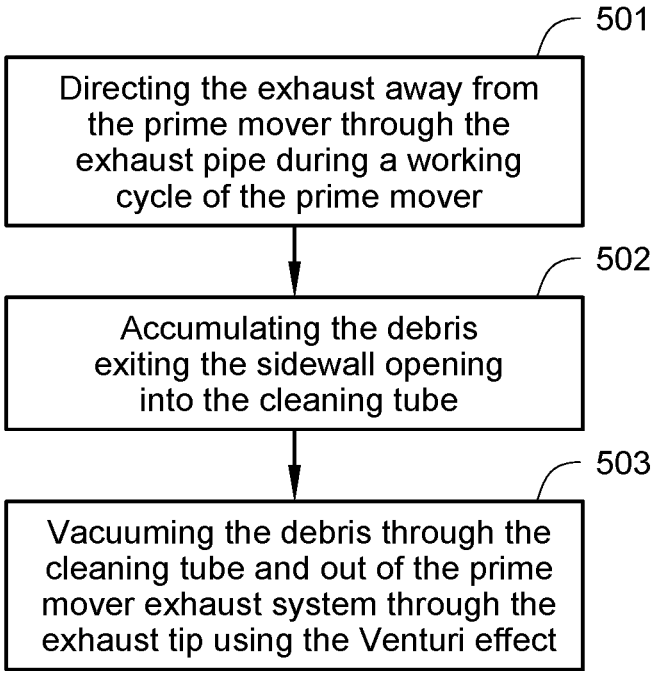
FIG. 6 shows a flow chart illustrating a method of self-cleaning debris from a self-cleaning prime mover exhaust system, according to at least one embodiment described and recited herein.

FIG. 6 shows a flow chart illustrating a method of self-cleaning debris from a self-cleaning prime mover exhaust system, according to at least one embodiment described and recited herein. The self-cleaning prime mover exhaust system may be a prime exhaust system provided by any embodiment mentioned above.

As shown in FIG. 6, at 501, the exhaust is directed away from the prime mover through the exhaust pipe 32 during a working cycle of the prime mover.

At 502, the debris exiting the sidewall opening 323 is accumulated into the cleaning tube 33.

At 503, the debris is vacuumed through the cleaning tube 33 and out of the self-cleaning prime mover exhaust system through the exhaust tip 31 using the Venturi effect.

It will be appreciated that the orders of 501 to 503 may vary. For example, in an embodiment, 501 may be implemented repeatedly, and 502 and 503 may be implemented between any two times of the implementations of 501.

Figure 7:
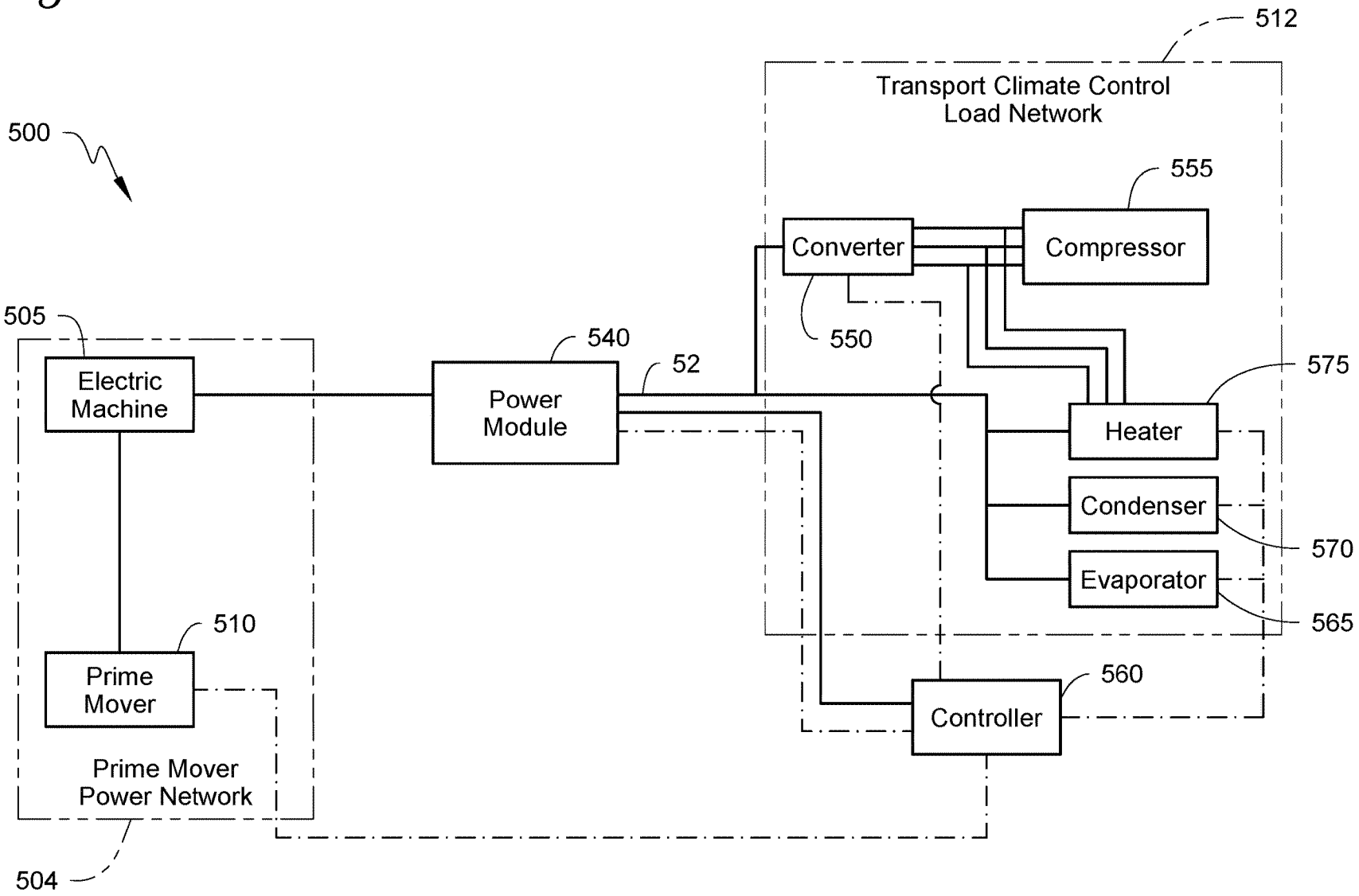
FIG. 7 shows a block diagram schematic of a power system for powering a transport climate control system, according to at least one embodiment described and recited herein.

FIG. 7 illustrates a block diagram schematic of one embodiment of a power system 500 for powering a transport climate control system (e.g., the transport climate control systems 105, 155, 210, 280 shown in FIGS. 1A-1D). The power system 500 includes a prime mover power network 504, and a transport climate control load network 512 connected to a power module 540.

The prime mover power network 504 includes a prime mover 510 and an electric machine 505 that may provide electric power to the power module 540. The prime mover 510 may be configured to generate mechanical power and the electric machine 510 may be configured to convert the mechanical power to electric power. The generated electric power is then sent by the prime mover power network 505 to the power module 540. In some embodiments, the prime mover 510 may be a vehicle prime mover used to move the vehicle that also provides power to the transport climate control load network 512 when available. Mechanical power generated by the prime mover 510 that may be used in the system 500 may be inconsistent and based on operation and vehicle load requirements of the vehicle. In other embodiments, the prime mover 510 and the electric machine 505 may be part of a generator set that provides power to the transport climate control load network 512. In yet further embodiments, the prime mover 510 and the electric machine 505 may be part of a CCU (e.g., the CCU 115, 165, 220, 290 shown in FIGS. 1A-D) to provide power to the transport climate control load network 512. In some embodiments the maximum power available from the prime mover power network 504 may never be sufficient to operate the transport climate control system operating at a full capacity.

Components of the transport climate control load network 512 may be, for example, part of a CCU that is mounted to the body of the vehicle (for example, truck, van, etc.). In some embodiments, the CCU may be above the cab of the truck (as shown in FIG. 1B). In one or more alternative embodiments, the CCU may be on the top of the TU (for example, a top of a box where the external condensers are located) (see FIG. 1C). In one or more other embodiments, the components of the transport climate control load network 512 may be DC powered components. In one or more other embodiments, the components of the transport climate control load network 512 may be AC powered components.

Alternatively, the transport climate control load network 512 may include both DC powered components and AC powered components.

As shown in FIG. 7, the transport climate control load network 512 includes at least one compressor 555, one or more evaporator blowers 565, one or more condenser fans 570, the heater 575, and the controller 560. It will be appreciated that in some embodiments, the transport climate control load network 512 does not include the heater 575. It will also be appreciated that in some embodiments, the transport climate control load network 512 does not include the at least one compressor 555. It will further be appreciated that in some embodiments, the transport climate control load network 512 may include thermal management of batteries, power electronics, etc. The transport climate control load network 512 also includes an inverter 550 that may be configured to boost the load power and convert the boosted load power to an AC load power. That is, the inverter 550 may be configured to boost power from the DC load bus 52 and converts the power to AC power to drive the compressor 555. In some embodiments, the inverter 550 may convert the load power to a high voltage AC power. As shown in FIG. 7, the inverter 550 may be configured to power the compressor 555 and optionally the heater 575. It will be appreciated that in other embodiments, the inverter 550 may power other components of the transport climate control load network 512 such as, for example, the one or more evaporator blowers 565, the one or more condenser fans 570, etc. In some embodiments, the inverter 550 may be a Compressor Drive Module (CDM).

The load DC bus 52 is connected to and powers each of the inverter 550, the one or more evaporator blowers 565, the one or more condenser fans 570, the heater 575, and the controller 560. It will be appreciated that the inverter 550 with the compressor 555 may require the most power of the various loads of the transport climate control load network 512. As shown in FIG. 7, in some embodiments, the inverter 550 may also power the heater 575.

Aspects:

It will be appreciated that any of aspects 1-22 can be combined.

Aspect 1. A self-cleaning prime mover exhaust system comprising:

an exhaust tip configured to eject exhaust out of the self-cleaning prime mover exhaust system;

an exhaust pipe configured to direct the exhaust away from a prime mover, wherein the exhaust pipe comprises:

a first exhaust section with a sidewall opening, and a second exhaust section, comprising an exhaust opening configured to direct the exhaust out of the exhaust pipe; and a cleaning tube having a first end and a second end, wherein the cleaning tube has a smaller sectional area compared with the exhaust tip, and the cleaning tube comprises:

a first cleaning section covering the sidewall opening, wherein the first cleaning section comprises a first cleaning opening at the first end of the cleaning tube, and a second cleaning section extending through the exhaust tip, the second cleaning section comprising a second cleaning opening at the second end of the cleaning tube, wherein the cleaning tube is configured to accumulate debris exiting the sidewall opening and configured to vacuum the debris out of the cleaning tube through the second cleaning opening and out of the self-cleaning prime mover exhaust system through the exhaust tip using the Venturi effect.

Aspect 2. The self-cleaning prime mover exhaust system of Aspect 1, wherein the second exhaust section extends through the exhaust tip and configured to direct the exhaust into the exhaust tip.

Aspect 3. The self-cleaning prime mover exhaust system of Aspect 2, wherein the exhaust tip has a larger sectional area compared with the exhaust pipe.

Aspect 4. The self-cleaning prime mover exhaust system of Aspect 2, wherein the exhaust tip comprises an exhaust end, and both the second exhaust section and the second cleaning section extend through the exhaust end.

Aspect 5. The self-cleaning prime mover exhaust system of Aspect 4, wherein both the exhaust opening and the second cleaning opening are disposed within the exhaust end.

Aspect 6. The self-cleaning prime mover exhaust system of Aspect 2, wherein the exhaust tip comprises an exhaust input opening, both the second exhaust section and the second cleaning section extend through the exhaust input opening, and the exhaust input opening has a sectional area which is larger compared with the second cleaning opening but smaller compared with the second exhaust opening.

Aspect 7. The self-cleaning prime mover exhaust system of Aspect 1, wherein the exhaust tip comprises an exhaust output opening configured to be exposed to an outside ambient.

Aspect 8. The self-cleaning prime mover exhaust system of Aspect 1, wherein the first exhaust section comprises a curved section, and the sidewall hole is located at an inflection position of the curved section.

Aspect 9. The self-cleaning prime mover exhaust system of Aspect 8, wherein the inflection position is at a bottom of the curved section along a direction of gravity.

Aspect 10. The self-cleaning prime mover exhaust system of Aspect 9, wherein the sidewall opening is a water drain hole configured to direct water out of the exhaust pipe towards a water drain.

Aspect 11. The self-cleaning prime mover exhaust system of Aspect 1, wherein the first cleaning section or the second cleaning section comprises a half tube disposed of on a surface of the exhaust pipe and extending along the exhaust pipe.

Aspect 12. The self-cleaning prime mover exhaust system of Aspect 1, wherein the first cleaning section or the second cleaning section comprises multiple end-to-end sections.

Aspect 13. A prime mover system, comprising:

a prime mover configured to generate mechanical power; and a self-cleaning prime mover exhaust system, comprising: an exhaust tip configured to eject debris out of a self-cleaning prime mover exhaust system; an exhaust pipe configured to direct exhaust away from a prime mover, wherein the exhaust pipe comprises: a first exhaust section with a sidewall opening, and a second exhaust section, comprising an exhaust opening configured to direct the exhaust; and a cleaning tube having a first end and a second end, wherein the cleaning tube has a smaller sectional area compared with the exhaust tip, and the cleaning tube comprises: a first cleaning section covering the sidewall opening, wherein the first cleaning section comprises a first cleaning opening at the first end of the cleaning tube, and a second cleaning section extending through the exhaust tip, the second cleaning section comprising a second cleaning opening at the second end of the cleaning tube, wherein the cleaning tube is configured to accumulate debris exiting the sidewall opening and configured to vacuum the debris out of the cleaning tube through the second cleaning opening and out of the self-cleaning prime mover exhaust system through the exhaust tip using the Venturi effect.

Aspect 14. The prime mover system of Aspect 13, wherein the second exhaust section extends through the exhaust tip and configured to direct the exhaust into the exhaust tip.

Aspect 15. The prime mover system of Aspect 14, wherein the exhaust tip comprises an exhaust end, and both the second exhaust section and the second cleaning section extend through the exhaust end.

Aspect 16. The prime mover system of Aspect 14, wherein the exhaust tip comprises an exhaust input opening, both the second exhaust section and the second cleaning section extend through the exhaust input opening, and the exhaust input opening has a sectional area which is larger compared with the second cleaning opening but smaller compared with the second exhaust opening.

Aspect 17. The prime mover system of Aspect 13, wherein the exhaust tip comprises an exhaust output opening configured to be exposed to an outside ambient.

Aspect 18. The prime mover system of Aspect 13, wherein the first exhaust section comprises a curved section, and the sidewall hole is located at an inflection position of the curved section.

Aspect 19. The prime mover system of Aspect 13, wherein the first cleaning section or the second cleaning section comprises a half tube disposed of on a surface of the exhaust pipe and extending along the exhaust pipe.

Aspect 20. The prime mover of Aspect 13, further comprising an exhaust fan, configured to vacuum the exhaust from the exhaust pipe.

Aspect 21. The prime mover of Aspect 13, wherein the prime mover comprises a diesel motor.

Aspect 22. A method for self-cleaning debris from a self-cleaning prime mover exhaust system that includes: an exhaust tip configured to eject exhaust out of the self-cleaning prime mover exhaust system; an exhaust pipe configured to direct the exhaust away from a prime mover, wherein the exhaust pipe comprises: a first exhaust section with a sidewall opening, and a second exhaust section, comprising an exhaust opening configured to direct the exhaust; and a cleaning tube having a first end and a second end, wherein the cleaning tube has a smaller sectional area compared with the exhaust tip, and the cleaning tube comprises: a first cleaning section covering the sidewall opening, wherein the first cleaning section comprises a first cleaning opening at the first end of the cleaning tube, and a second cleaning section extending through the exhaust tip, the second cleaning section comprising a second cleaning opening at the second end of the cleaning tube, wherein the cleaning tube is configured to accumulate debris exiting the sidewall opening and configured to vacuum the debris out of the cleaning tube through the second cleaning opening and out of the self-cleaning prime mover exhaust system through the exhaust tip using the Venturi effect; and the method comprises:

directing the exhaust away from the prime mover through the exhaust pipe during a working cycle of the prime mover;

accumulating the debris exiting the sidewall opening into the cleaning tube; and vacuuming the debris through the cleaning tube and out of the self-cleaning prime mover exhaust system through the exhaust tip using the Venturi effect.

The terminology used in this Specification is intended to describe particular embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This Specification and the embodiments described are exemplary only, with the true scope and spirit of the disclosure being indicated by the claims that follow.

I claim:

1. A self-cleaning prime mover exhaust system comprising:

an exhaust tip configured to eject exhaust out of the self-cleaning prime mover exhaust system;

an exhaust pipe configured to direct the exhaust away from a prime mover, wherein the exhaust pipe comprises:

a first exhaust section with a sidewall opening, and a second exhaust section, comprising an exhaust opening configured to direct the exhaust out of the exhaust pipe; and a cleaning tube extending along a surface of the exhaust pipe, the cleaning tube having a first end and a second end, wherein the cleaning tube has a smaller sectional area compared with the exhaust tip so as to create a vacuuming air flow in the cleaning tube because of the Venturi effect, and the cleaning tube comprises:

a first cleaning section covering the sidewall opening, wherein the first cleaning section comprises a first cleaning opening at the first end of the cleaning tube, and a second cleaning section extending through the exhaust tip, the second cleaning section comprising a second cleaning opening at the second end of the cleaning tube, wherein the exhaust pipe includes a bend at the sidewall opening that is configured such that debris in the exhaust pipe flows back away from the exhaust tip into the sidewall opening and into the cleaning tube between working cycles of the prime mover when there is no exhaust flow in the exhaust pipe, and wherein the cleaning tube is configured to accumulate the debris exiting the sidewall opening between the working cycles of the prime mover when there is no exhaust flow in the exhaust pipe and configured to, between the working cycles of the prime mover, vacuum the debris out of the cleaning tube through the second cleaning opening and out of the self-cleaning prime mover exhaust system through the exhaust tip using the Venturi effect.

2. The self-cleaning prime mover exhaust system of claim 1, wherein the second exhaust section extends through the exhaust tip and configured to direct the exhaust into the exhaust tip.

3. The self-cleaning prime mover exhaust system of claim 2, wherein the exhaust tip has a larger sectional area compared with the exhaust pipe.

4. The self-cleaning prime mover exhaust system of claim 2, wherein the exhaust tip comprises an exhaust end, and both the second exhaust section and the second cleaning section extend through the exhaust end.

5. The self-cleaning prime mover exhaust system of claim 4, wherein both the exhaust opening and the second cleaning opening are disposed within the exhaust end.

6. The self-cleaning prime mover exhaust system of claim 2, wherein the exhaust tip comprises an exhaust input opening, both the second exhaust section and the second cleaning section extend through the exhaust input opening, and the exhaust input opening has a sectional area which is larger compared with the second cleaning opening but smaller compared with the second exhaust opening.

7. The self-cleaning prime mover exhaust system of claim 1, wherein the exhaust tip comprises an exhaust output opening configured to be exposed to an outside ambient.

8. The self-cleaning prime mover exhaust system of claim 1, wherein the first exhaust section comprises a curved section, and the sidewall hole is located at an inflection position of the curved section.

9. The self-cleaning prime mover exhaust system of claim 8, wherein the inflection position is at a bottom of the curved section along a direction of gravity.

10. The self-cleaning prime mover exhaust system of claim 9, wherein the sidewall opening is a water drain hole configured to direct water out of the exhaust pipe towards a water drain.

11. The self-cleaning prime mover exhaust system of claim 1, wherein the first cleaning section or the second cleaning section comprises a half tube disposed of on a surface of the exhaust pipe and extending along the exhaust pipe.

12. The self-cleaning prime mover exhaust system of claim 1, wherein the first cleaning section or the second cleaning section comprises multiple end-to-end sections.

13. A prime mover system, comprising:

a prime mover configured to generate mechanical power; and a self-cleaning prime mover exhaust system, comprising: an exhaust tip configured to eject debris out of the self-cleaning prime mover exhaust system; an exhaust pipe configured to direct exhaust away from the prime mover, wherein the exhaust pipe comprises: a first exhaust section with a sidewall opening, and a second exhaust section, comprising an exhaust opening configured to direct the exhaust; and a cleaning tube extending along a surface of the exhaust pipe, the cleaning tube having a first end and a second end, wherein the cleaning tube has a smaller sectional area compared with the exhaust tip so as to create a vacuuming air flow in the cleaning tube because of the Venturi effect, and the cleaning tube comprises: a first cleaning section covering the sidewall opening, wherein the first cleaning section comprises a first cleaning opening at the first end of the cleaning tube, and a second cleaning section extending through the exhaust tip, the second cleaning section comprising a second cleaning opening at the second end of the cleaning tube, wherein the exhaust pipe includes a bend at the sidewall opening that is configured such that debris in the exhaust pipe flows back away from the exhaust tip into the sidewall opening and into the cleaning tube between working cycles of the prime mover when there is no exhaust flow in the exhaust pipe, and wherein the cleaning tube is configured to accumulate the debris exiting the sidewall opening between the working cycles of the prime mover when there is no exhaust flow in the exhaust pipe and configured to, between the working cycles of the prime mover, vacuum the debris out of the cleaning tube through the second cleaning opening and out of the self-cleaning prime mover exhaust system through the exhaust tip using the Venturi effect.

14. The prime mover system of claim 13, wherein the second exhaust section extends through the exhaust tip and configured to direct the exhaust into the exhaust tip.

15. The prime mover system of claim 14, wherein the exhaust tip comprises an exhaust end, and both the second exhaust section and the second cleaning section extend through the exhaust end.

16. The prime mover system of claim 14, wherein the exhaust tip comprises an exhaust input opening, both the second exhaust section and the second cleaning section extend through the exhaust input opening, and the exhaust input opening has a sectional area which is larger compared with the second cleaning opening but smaller compared with the second exhaust opening.

17. The prime mover system of claim 13, wherein the exhaust tip comprises an exhaust output opening configured to be exposed to an outside ambient.

18. The prime mover system of claim 13, wherein the first exhaust section comprises a curved section, and the sidewall hole is located at an inflection position of the curved section.

19. The prime mover system of claim 13, wherein the first cleaning section or the second cleaning section comprises a half tube disposed of on a surface of the exhaust pipe and extending along the exhaust pipe.

20. A method for self-cleaning debris from a self-cleaning prime mover exhaust system that includes: an exhaust tip configured to eject exhaust out of the self-cleaning prime mover exhaust system; an exhaust pipe configured to direct the exhaust away from a prime mover, wherein the exhaust pipe comprises: a first exhaust section with a sidewall opening, and a second exhaust section, comprising an exhaust opening configured to direct the exhaust; and a cleaning tube extending along a surface of the exhaust pipe, the cleaning tube having a first end and a second end, wherein the cleaning tube has a smaller sectional area compared with the exhaust tip so as to create a vacuuming air flow in the cleaning tube because of the Venturi effect, and the cleaning tube comprises: a first cleaning section covering the sidewall opening, wherein the first cleaning section comprises a first cleaning opening at the first end of the cleaning tube, and a second cleaning section extending through the exhaust tip, the second cleaning section comprising a second cleaning opening at the second end of the cleaning tube, wherein the exhaust pipe includes a bend at the sidewall opening that is configured such that debris in the exhaust pipe flows back away from the exhaust tip into the sidewall opening and into the cleaning tube between working cycles of the prime mover when there is no exhaust flow in the exhaust pipe, and wherein the cleaning tube is configured to accumulate the debris exiting the sidewall opening between the working cycles of the prime mover when there is no exhaust flow in the exhaust pipe and configured to, between the working cycles of the prime mover, vacuum the debris out of the cleaning tube through the second cleaning opening and out of the self-cleaning prime mover exhaust system through the exhaust tip using the Venturi effect; and the method comprises:

directing the exhaust away from the prime mover through the exhaust pipe during a working cycle of the prime mover;

during the working cycle of the prime mover, the debris in the exhaust pipe flowing with the exhaust and discharged from the exhaust tip;

between working cycles of the prime mover, the debris in the exhaust pipe flowing back away from the exhaust tip into the sidewall opening and accumulating in the cleaning tube;

and between the working cycles of the prime mover while no new exhaust is created and no exhaust flow in the self-cleaning prime mover exhaust system, the cleaning tube creating a Venturi effect and directing debris in the cleaning tube towards the exhaust tip and through the sidewall opening;

accumulating the debris exiting the sidewall opening into the cleaning tube; and vacuuming the debris through the cleaning tube and out of the prime mover exhaust system through the exhaust tip using the Venturi effect.

* * * * *